United States Patent [19]

Lehmann et al.

[11] Patent Number: 5,069,650

[45] Date of Patent: Dec. 3, 1991

[54] POP-OUT TOY

[76] Inventors: Roger W. Lehmann, 18 Flintlock Ct., Bernardsville, N.J. 07924; Michael I. Statten, 4 Farmers Rd., Kings Point, N.Y. 11024

[21] Appl. No.: 484,225

[22] Filed: Feb. 23, 1990

[51] Int. Cl.[5] ..... A63H 33/42

[52] U.S. Cl. ..... 446/476; 446/310; 446/486

[58] Field of Search ..... 446/310, 308, 309, 486, 446/487, 489, 476, 478, 475, 430, 435, 4, 6; 292/DIG. 4

[56] References Cited

U.S. PATENT DOCUMENTS

| | | | |
|---|---|---|---|
| 1,089,229 | 3/1914 | Klein | 446/310 |
| 4,227,726 | 10/1980 | Sorimachi | 292/DIG. 4 X |
| 4,246,719 | 1/1981 | Kulesza et al. | 446/310 |

FOREIGN PATENT DOCUMENTS

| | | | |
|---|---|---|---|
| 992454 | 5/1965 | United Kingdom | 446/486 |
| 1315649 | 5/1973 | United Kingdom | 446/310 |

*Primary Examiner*—Mickey Yu

*Attorney, Agent, or Firm*—Samuel S. Stoll

[57] ABSTRACT

A pop-out toy having a latch mechanism controlled by manual pressure applied to the pop-out element, whereby pressure applied to the pop-out element when in retracted position unlatches it for pop-out movement, and pressure applied to the pop-out element when it is in pop-out position causes it to move into latched retracted position. In both instances, manual pressure on the pop-out element controls its movement from one position to the other, and, in the case of the pop-out movement, it prevents the sudden jack-in-the-box actioin that frightens young children.

10 Claims, 5 Drawing Sheets

POP-OUT TOY

BACKGROUND OF THE INVENTION

1. Reference to Related Document

Reference is made to Disclosure Document No. 239,815, filed Nov. 17, 1990.

2. Field of the Invention

Pop-up toys naving spring-urged pop-up elements, traditionally in the form of jack-in-the-box toys.

3. Descriotion of the Prior Art

The closest prior art known to applicants' invention is represented the following United States patents:

| | |
|---|---|
| 555,740 | Scarfe |
| 2,446,540 | Leach |
| 2,646,646 | Glass |
| 2,858,644 | Derham |
| 3,538,620 | Kohner et al |
| 3,894,353 | Oguchi |
| 4,246,719 | Kulesza et al |

The foregoing patents disclose various forms of jack-in-the-box toys, e.g., Leach. But the pop-up operation of this toy is not controlled by manual pressure applied to the popup element. Derham shows another form of jack-in-the-box where the pop-up element is controlled by manual deformation of the enclosure for the pop-up element.

In Kulesza, the pop-up operation is controlled by a tilting fluid-containing cup. In Kohner, the pop-up operation is controlled by a separate control element that controls a plurality of pop-up elements. In none of the prior art patents is there a disclosure of a pop-up toy in which both the pop-up and retraction operations are controlled by pressure applied manually to the pop-up element.

SUMMARY OF THE INVENTION

The invention is of a pop-out toy wherein manual pressure upon the pop-out element controls both the pop-out and retraction operations. The toy is intended for very young children who would be unable to master more complicated controls. It is a pop-out toy, as distinguished from traditional pop-up toys because it is adapted to pop-out not only upwardly but also in other directions, e.g., horizontally.

The present invention also eliminates the experience, frightening some children, of the sudden emergence of a popup element from a conventional jack-in-the-box or the versions thereof in the above-cited patents. Thus, in the present invention, when the pop-out element is manually operated to release the latch mechanism, it is the child's hand that manually operates and controls it to prevent such sudden jack-in-the-box action.

BRIEF DESCRIPTION OF THE DRAWINGS

FIG. 6 is another similar view showing the roof section pushed below its latched position, and showing the pinkeeper moved out of latching engagement with the pin and into post-latching camming engagement therewith.

DESCRIPTION OF PREFERRED EMBODIMENT OF THE INVENTION

Figure 1:
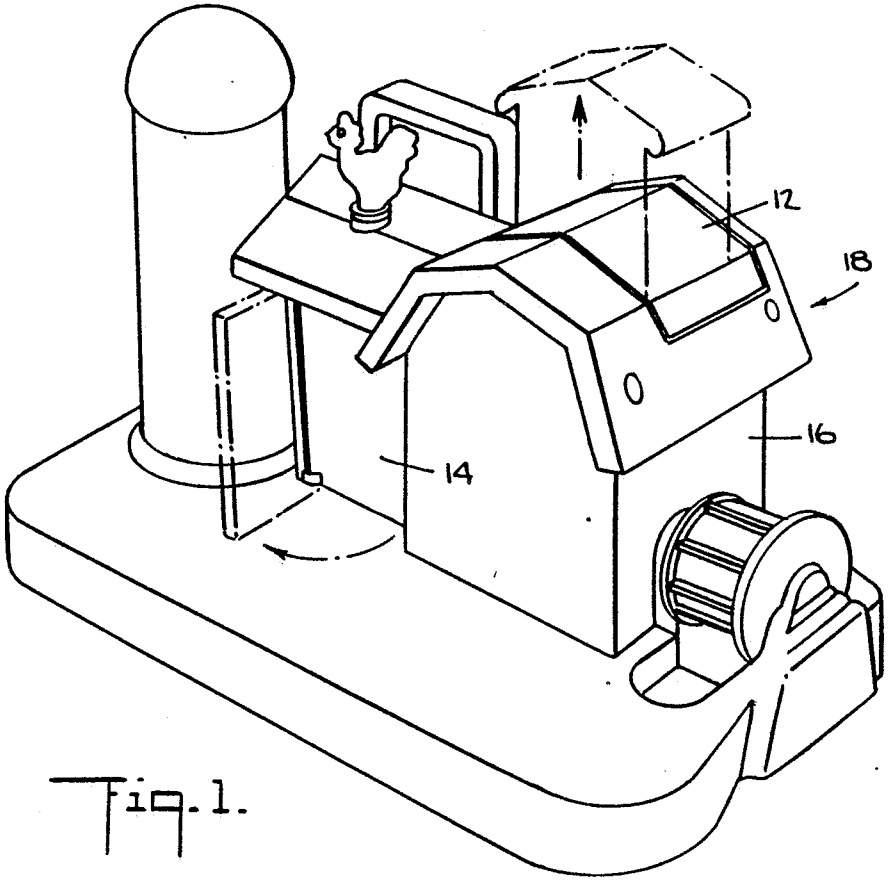
FIG. 1 is a perspective view of a toy, simulating a farm building, wherein a roof section and a door comprise pop-out elements that illustrate the present invention.
Figure 2:
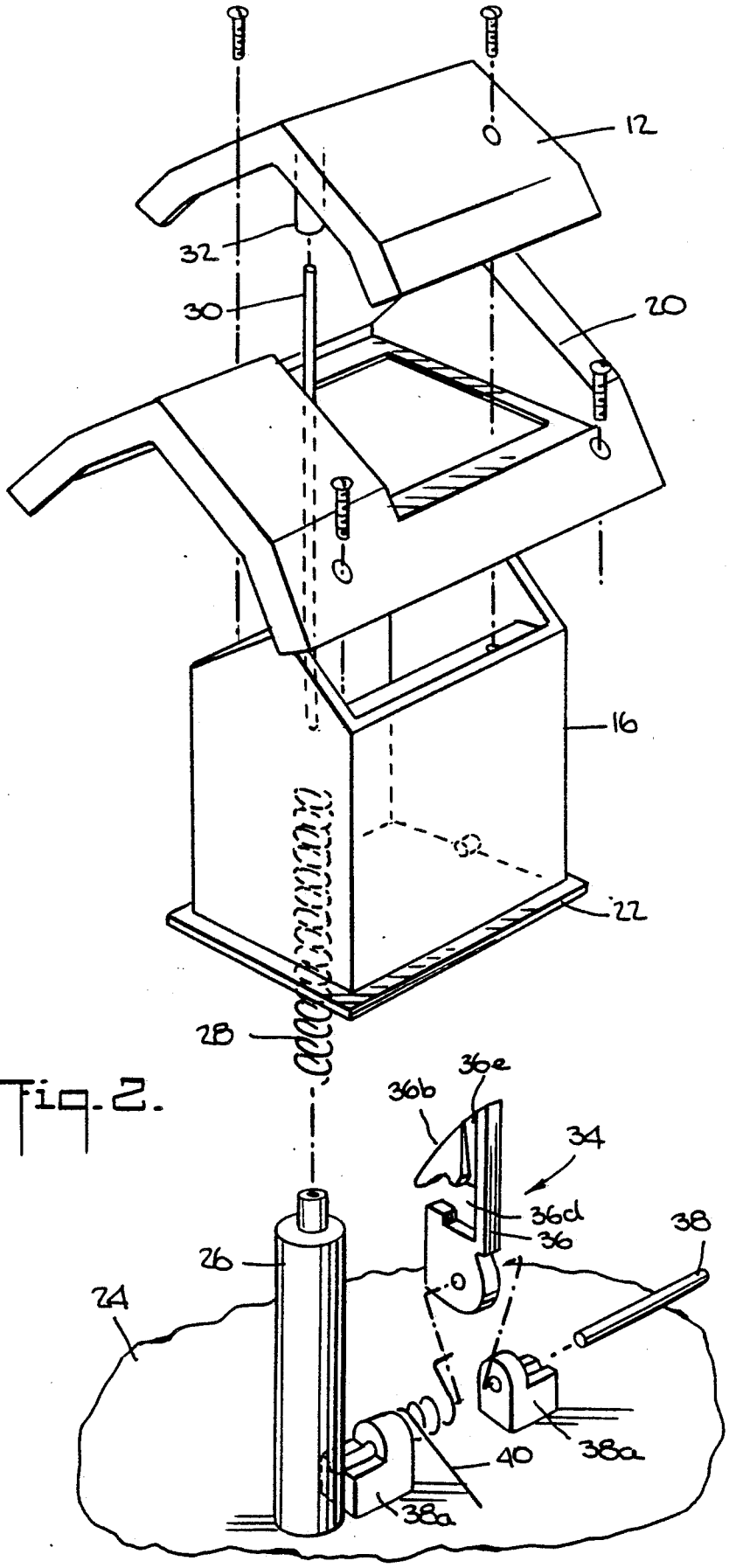
FIG. 2 is an exploded view of the roof section and its latching mechanism.

Referring to FIG. 1, it will be understood that farm building 10 is an illustration of the many toys that may embody the present invention. The invention is embodied in the farm building in connection with roof section 12 and door 14 This too is illustrative and is intended to show that the invention is applicable to a pop-out element (roof section) that engages in vertical rectilinear movement and a pop-out element (door) that engages in horizontal pivotal movement. The pivotal axis of door 14 is vertical, but it may also be horizontal, as in a hatchway. For the purposes of the specification and appended claims, a door moving horizontally and a roof section moving vertically will both be considered pop-out elements.

Referring now to the roof section embodiment of the invention, it will be seen that roof section 12 is secured to a silo-type structure 16 and the two together comprise popout element 18. This pop-out section is vertically movable in a shaftway structure 20 that is part of, or built into, the farm building. Downward movement of the pop-out element is limited by roof section 12 engaging the shaftway structure. The range of vertical movement of the pop-out element is between these two limitations.

Formed on base 24 of the shaftway is a tubular member 26 that supports a coiled compression spring 28 and a rod 30 tha extends through said spring and into said tubular memt ber. The upper end of the rod is secured to a second tubular member 32 formed on the roof section 12. The function of spring 28 is to urge the pop-out element 18 (roof section 12 plu silo structure 16) upwardly into pop-out position.

Also mounted on base 24 is latching mechanism 34 that performs the function of holding the pop-out element is in retracted position against the action of spring 28. When the latching mechanism releases the pop-out element, as will be described in relation to FIGS. 3–7, said pop-out element is free to move into pop-out position under the action of said spring.

Latching mechanism 34 comprises a pin-keeper 36 that is pivotally mounted on a pivot pin 38 supported on base 24 and torsion spring urges the pin-keeper to pivot in clockwise direction about the axis of pivot pin 38 as viewed in FIGS. 3–6.

It will now be noted that silo structure 16 is open at the bottom to receive the pin-keeper 36. Formed on one of the inner walls of said silo structure is a pin 42 that is located for engagement with the pin keeper. Specifically, the pin-keeper has a generally hook-shaped head 36*a* with a convex cam-shaped top edge 36*b* and it is this cam-shaped edge that pin 42 initially engages when the pop-out element is manually pushed downwardly toward retracted position. Further movement of the pop-out element in downward direction causes pin 42 to cam the pin-keeper leftwardly, that is, in counter-clockwise direction as viewed in FIG. 4, until said pin 4 disengages the head of the pin-keeper. This results in the pin-keeper pivoting back in clockwise direction under the action of spring 40 until pin 42 is latched in notch 36*c* to hold the pop-out element in its retracted position. See FIG. 5.

To release the pop-out element for movement into pop-out position, it is manually depressed a short distance below its latched position, sufficient to disengage pin 42 from notch 36*c*. This results in the pin-keeper pivoting in clockwise direction from its FIG. 5 to its FIG. 6 position under the action of spring 40. This movement is possible because of passageway 36*d* that is formed below the hook-shaped head 36*a* to provide clearance for pin 42. The result is that said pin is aligned with a cam-faced channel 36*e*. See FIG. 6.

The pop-out element is now released from the latching mechanism and it starts to move upwardly toward its pop-out position under the action of spring 28. What remains to be done is to cam the pin-keeper out of the way of the pin 42. This is accomplished by the pin riding up the cam-faced channel 36*e* and thereby camming the pin-keeper to the right as viewed in FIG. 7.

Figure 4:
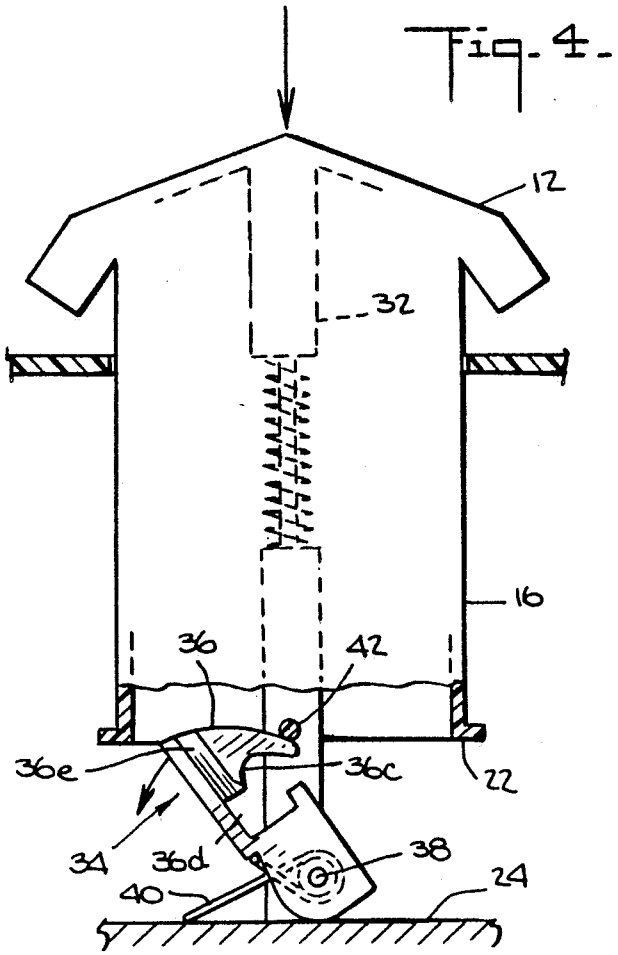
FIG. 4 is a similar view showing the roof section in depressed position, a pin on said roof section in prelatching camming engagement with the pin-keeper of the latching mechanism.
Figure 3:
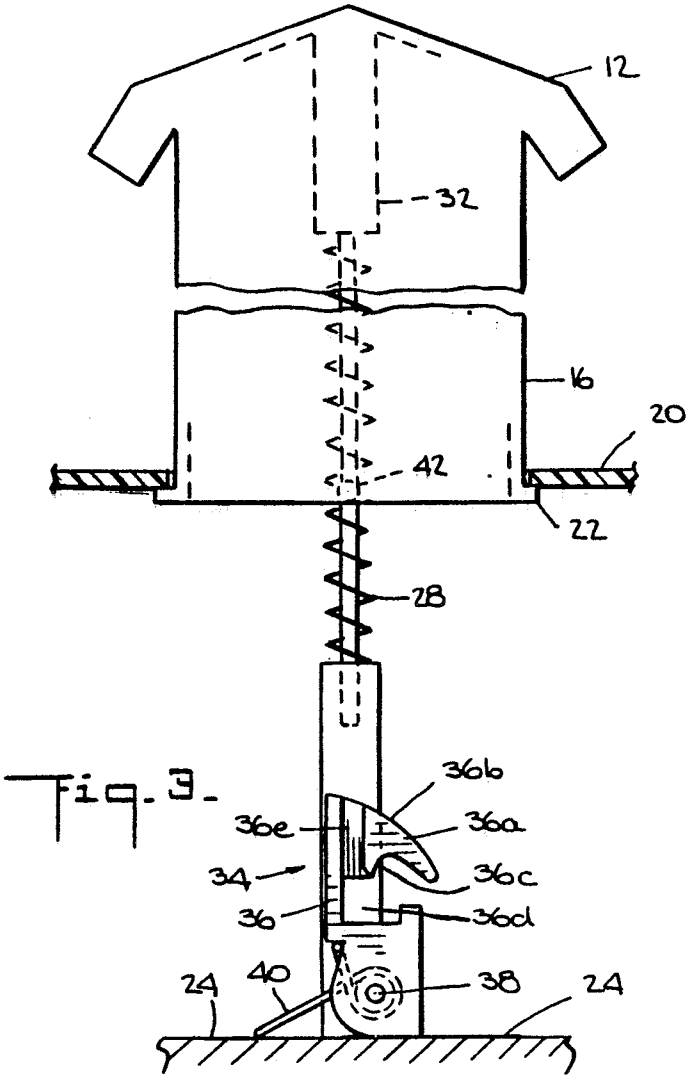
FIG. 3 is an enlarged, fragmentary view of the roof section pop-out mechanism showing the roof section in pop-out position disengaged from the latching mechanism.
Figure 7:
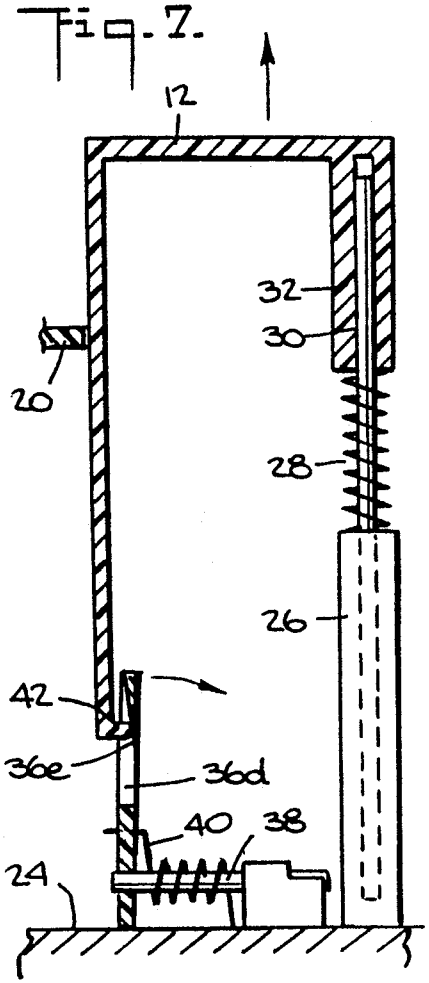
FIG. 7 is a view of the roof section and latching mechanism, turned 90 degrees from the view of FIG. 6, the roof section being shown moving toward its pop-out position, its pin camming the pin-keeper aside to free the roof section for such movement.
Figure 5:
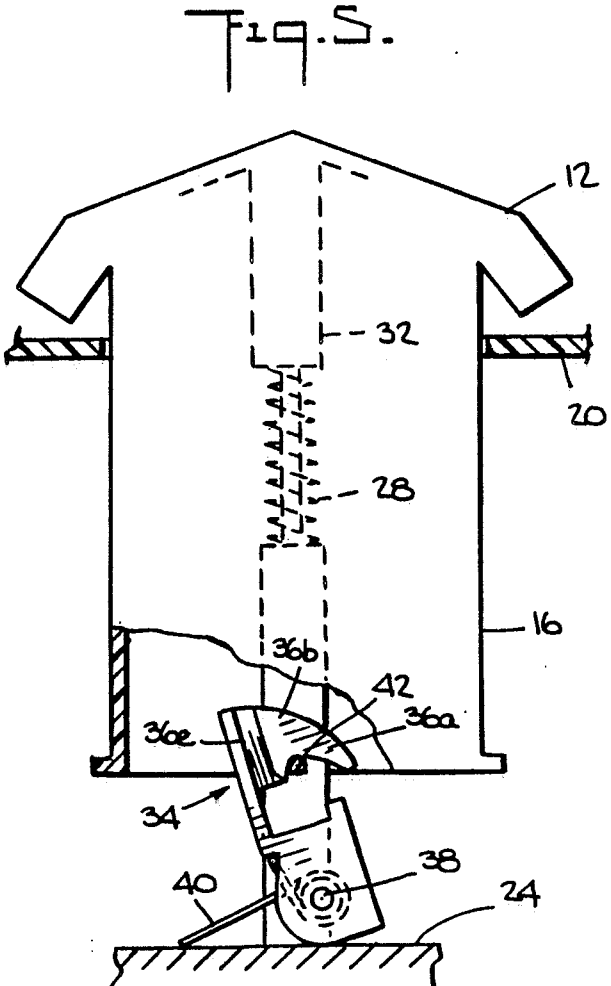
FIG. 5 is another similar view showing the roof section in latched position, the pin in latched engagement with the pin-keeper.
Figure 8:
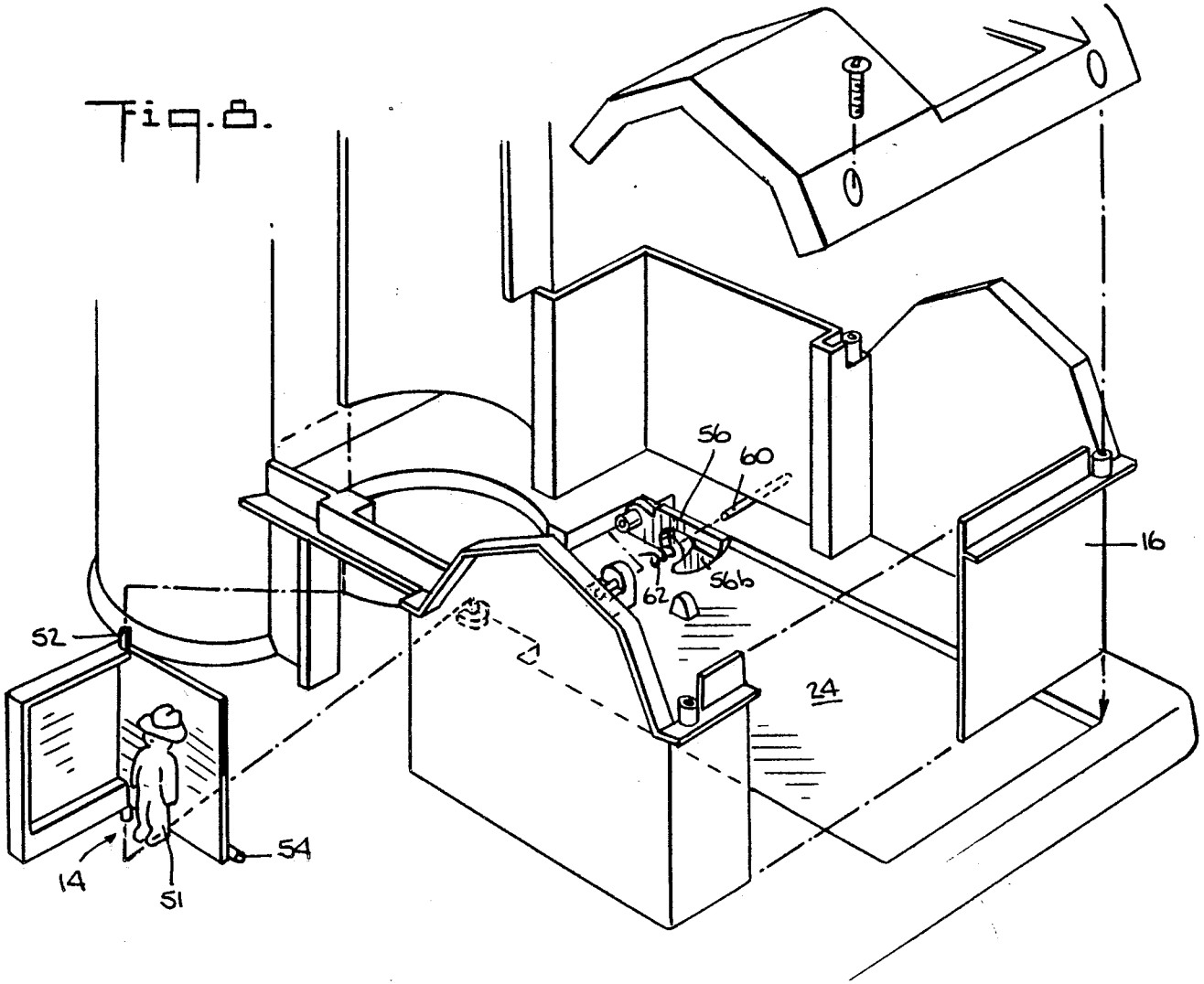

It will now be recalled (see the brief description of FIG. 7).that FIG. 7 is turned 90 degrees from its position in FIG. 6. This means that the camming action of pin 42 shown in FIG. 7 causes the pin keeper to pivot in a plane 90 degrees removed from the pivoting plane shown in FIGS. 4, 5 and 6. The pivoting movement in FIGS. 4, 5 and 6 is around the longitudinal axis of pivot pin 38; the pivoting movement in FIG. 7 is on an axis perpendicular to said longitudinal axis. The pivotal movement shown in FIG. 7 is made possible by sufficient pivotal clearance between the pin-keeper and said pivot pin 38, or between said pivot pin and its bearings 38*a*. Like the pivotal movement of the pin-keeper in FIG. 4, its pivotal movement in FIG. 7 is against the bias of torsion spring 36.

Figure 9:
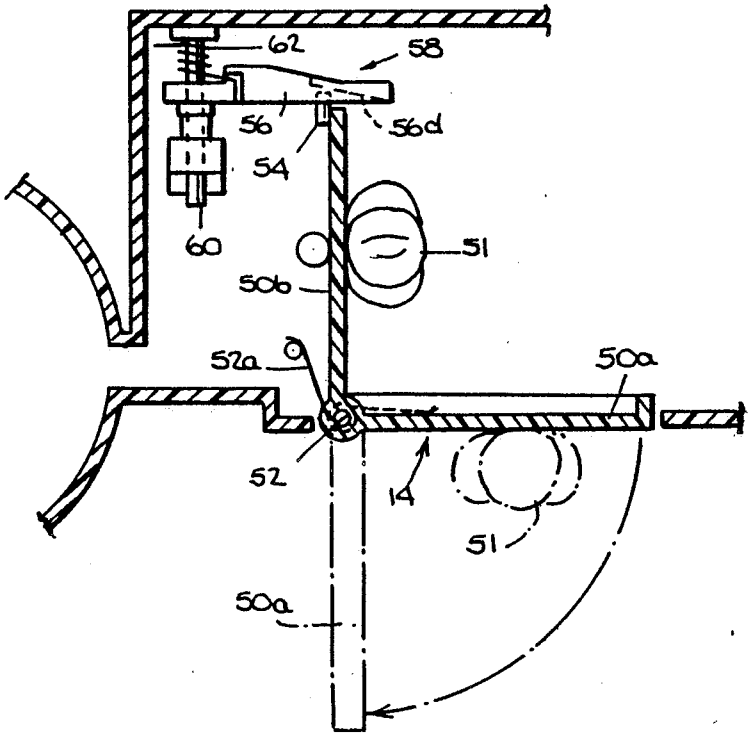
FIG. 9 is a fragmentary top view of the second form of the invention showing the door form of pop-out element and the latching mechanism therefor.
Figure 10:
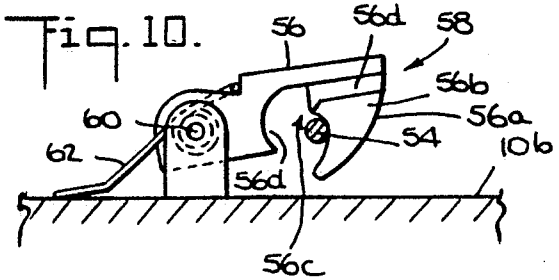
FIG. 10 is an enlarged side view of the latching mechanism shown in FIG. 9.
Figure 8:
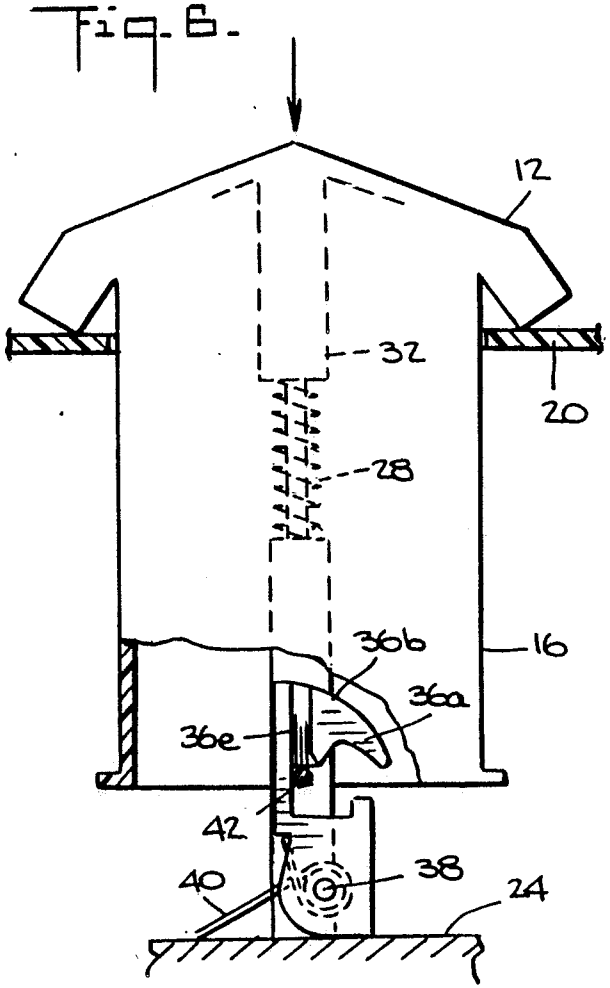
FIG. 8 is an exploded view of the door form of the invention.

A second embodiment of the invention is shown in FIGS. 8, 9 and 10. This embodiment applies the principles of the invention to a pop-out element in the form of spring-biased door 50 supporting the figure of a farmer 51. Although the movement of this door is a conventional swinging movement in a horizontal plane, while the movement of the pop-out element of the first embodiment is in a vertical plane, the operations and mechanisms are substantially the same.

Swinging door 50 may be installed in the same toy farm building 10 as the first embodiment, or in a separate toy. For convenience, it is shown herein installed in the same farm building 10. Specifically, door 50 is mounted on pivot pins 52 which are supported on the same building structure that supports the pop-out element of the first embodiment. The door is spring-urged toward pop-out (open) position by a torsion spring 52*a* acting between the door and an adjacent member 10*a* on the building structure. Swinging the door into retracted (closed) position is effected manually against the action of spring 52*a*.

It will be noted that door 50 is a double door consisting of outer and inner door sections 50*a* and 50*b*, respectively. These door sections are attached to each other at an angle of 90 degrees and share the same pivot pins and vertical axis. The inner door section 50*b* serves as a support for the farmer FIG. 51. The outer door section 50*a* serves as a closure for the doorway.

Attached to the free vertical edge of inner door section 50*b* is a pin 54 that is engageable with pin-keeper 56 of latching mechanism 58. This latching mechanism is mounted on the farm building structure, e.g., on floor 10*b*. It corresponds, substantially, to latching mechanism 34, except that pin-keeper 54 of latching mechanism 58 extends generally horizontally, while pin-keeper 36 of latching mechanism 34 extends generally vertically, when they are disengaged from their respective pins.

There is also a difference between the paths of movement of pins 42 and 54 as they move into and out of engagement with their respective keepers 36 and 56. Pin 42 moves generally vertically in essentially a straight path, while pin 54 moves generally horizontally in an arcuate path about the axis of pivot pins 52. Nevertheless, the action is substantially the same. When outer door section 50*a* is swung manually from open to closed position, pin 54 on inner door section 50*b* will engage curved camming edge 56*a* of hook-shaped head 56*b* and cause pin-keeper 56 to pivot upwardly about pin 60 and against the spring tension of torsion spring 62. Pin 54 will thereby by-pass the hook-shaped head 56*b* and the pin-keeper will thereupon snap back under the action of spring 62 to lock the pin within the crook 56*c* of the hook-shaped head. This holds the outer door section 50*a* in closed position against the action of spring 52*a*.

Further manual movement of the door beyond closed position will cause the pin to move out of crook 56*c* through passageway 56*d* and into alignment with cam-shaped channel 56*d*. This cam channel corresponds to cam-shaped channel 36*e* of the first embodiment. When door 50 is manually released, it swings outwardly under the action of spring 52*a*. This causes pin 54 to cam itself through cam channel 56*d*, thereby pushing itself out of engagement with the pin-keeper 56 and enabling door 50 to move into its pop-out position. Moving into pop-out position thereby is the farmer figure o the inner door section.

It will be understood that the foregoing description of two embodiments of the invention in a single farm building toy is not intended to limit the invention to that specific kind of toy. The invention is applicable to all forms of jack-in-the-box toys to the extent of the scope and coverage of the appended claims.

What is claimed is:

1. A pop-out toy, comprising:

a. a toy having a toy building structure, b. a manually actuable pop-out toy element movably mounted in said toy building structure for movement in a first direction into pop-out position relative to said toy building structure, and in the opposite direction into retracted position relative to said toy building structure, c. first spring means between said toy building structure and said pop-out toy element biased to urge said pop-out toy element in said first direction toward the pop-out position, d. said pop-out toy element being manually movable in said opposite direction against said first spring means toward the retracted position, e. a latch mechanism between said toy building structure and said pop-out toy element, f. said latch mechanism comprising a pin on said pop-out toy element, g. a pin-keeper pivotally connected to said toy building structure, and h. second spring means urging said pin-keeper into latching engagement with said pin to prevent the pop-out toy element form moving into pop-out position either by manual actuation in said first direction or under the action of the first spring means, i. means, operated by said pop-out toy element when it is moved manually further in said opposite direction, for disengaging the pin-keeper from the pin to free the pop-out toy element for movement in said first direction under the action of the first spring means into pop-out position, j. the pin-keeper being pivotally movable in two planes, k. said pin-keeper being pivotally movable in the first of said planes into latching engagement with the pin, l. said pin-keeper being further pivotally movable in the first of said palens out of latching egnagement with said pin, and m. said pin-keeper being then pivotally movable in the second of said planes to release the pin and thereby release the pop-out toy element for movement under the action of the first spring means into pop-out position.

2. A pop-out toy in accordance with claim 1, wherein:

a. the pin-keeper is pivotally movable in the first plane into a first location, under the action of the second spring means, wherein it is in latching engagement with the pin, b. the pin-keeper being further pivotally movable in the first plane into a second location, under the action of the second spring means, wherein it is out of latching engagement with the pin, c. the pin-keeper being pivotally movable in the second plane, under the action of the first spring means, to release the pin and to enable the pop-out toy element to move into pop-out position under the action of said first spring means.

3. A pop-out toy in accordance with claim 2, wherein:

a. the pin-keeper is provided with a pin-camming surface, b. said pin-camming surface being engageable with the pin when the pin-keeper is pivotally moved in the first plane into said second location, c. said pin-camming surface being adapted, when the pin-keeper is pivotally moved in the second plane, to cam the pin away from the pin-keeper in order to release the pin and to enable the pop-out toy element to move into pop-out position under the action of said first spring means.

4. A pop-out toy in accordance with claim 3, wherein:

a. a pin passage is provided in the pin-keeper for clearance of the pin when the pin-keeper moves in the first plane from its first location to its second location, b. thereby positioning the pin for engagement with the pin-camming surface.

5. A pop-out toy in accordance with claim 2, wherein:

a. the pop-out toy element is manually movable from pop-out position to an intermediate position wherein the pin-keeper is adapted to move into latching engagement with the pin, and b. said pop-out toy element being further manually movable to retracted position wherein the pin-keeper is adapted to move out of latching engagement with said pin.

6. A pop-out toy in accordance with claim 1, wherein: the pop-out toy element is mounted for rectilinear movement in the toy building structure.

7. A pop-out toy in accordance with claim 6, wherein: the pop-out toy element is mounted for vertical rectilinear movement in the toy building structure.

8. A pop-out toy in accordance with claim 1, wherein: the pop-out toy eklement is mounted for pivotal movement in the toy building structure.

9. A pop-out toy in accordance with claim 8, wherein: the pop-out toy element is mounted for pivotal movement in said toy building structure about a vertical pivotal axis.

10. A pop-out toy, comprising:

a. a toy having a housing, b. a pop-out element movably mounted in said housing for movement in one direction into pop-out position relative to said housing, and in the other direction into retracted position relative to said housing, c. first spring means between said housing and said pop-out element biased to urge said pop-out element toward the pop-out position, d. said pop-out element being manually movable against said first spring means toward the retracted position, e. a latch mechanism between said housing and said pop-out element, f. said latch mechanism comprising a pin on said pop-out element, g. a pin-keeper pivotally connected to said housing, and h. second spring means urging said pin-keeper into latching engagement with said pin to prevent the pop-out element from moving into pop-out position under the action of the first spring means, i. means for disengaging the pin-keeper from the pin to free the pop-out element for movement under the action of the first spring means into pop-out position, j. the pin-keeper being pivotally movable in two planes, k. said pin-keeper being pivotally movable in the first of said fplanes into latching engagement with the pin, l. said pin-keeper being further pivotally movable in the first of said planes out of latching engagement with said pin, and m. said pin-keeper being then pivotally movable in the second fo said planes to release the pin and thereby release the pop-out element for movement under the action of the first spring means into pop-out position, n. said pop-out element being mounted for pivotal movement in said housing about a vertical pivotal axis, o. said housing comprising a building structure and the pop-out element comprising a door mounted in a doorway in said building structure, p. said door havign outer an inner door sections, q. said door sections being connected at a 90° degree angle along a vertical line of juncture corresponding to the vertical pivotal axis of the door.

* * * * *